United States Patent [19]

Smith

[11] Patent Number: 4,696,318

[45] Date of Patent: Sep. 29, 1987

[54] WASHING METHODS AND APPARATUS FOR HEAT EXCHANGER TUBE CLEANING PLUGS

[75] Inventor: Millard F. Smith, Westport, Conn.

[73] Assignee: Slickbar Products Corp., Southport, Conn.

[21] Appl. No.: 797,203

[22] Filed: Nov. 12, 1985

[51] Int. Cl.[4] ..... B08B 3/02

[52] U.S. Cl. ..... 134/73; 134/104; 134/131; 15/104.06 R

[58] Field of Search ..... 134/104, 131, 166 C, 134/129, 73; 15/104.06 R, 104.06 A; 165/95

[56] References Cited

U.S. PATENT DOCUMENTS 3,872,920 3/1975 Honma et al. ..... 165/95
3,919,732 11/1975 Honma et al. ..... 165/95 X
3,978,917 9/1976 Honma et al. ..... 15/3.51 X

*Primary Examiner*—Harvey C. Hornsby
*Assistant Examiner*—Frankie L. Stinson
*Attorney, Agent, or Firm*—Mattern, Ware, Stoltz & Fressola

[57] ABSTRACT

Methods and apparatus are described for cleaning and recycling flexible floating cleaning plugs introduced into and propelled by water pressure through the cooling water tubes of a power plant heat exchanger located near a flowing body of water. A cooling water outlet conduit delivers used cooling water from the exit end of the heat exchanger cooling water tubes, together with a plurality of flexible floating cleaning plugs propelled therethrough, discharging them into the flowing body of water upstream from a containment barrier. The barrier has a convergent weir region at its downstream end, and a conveyor carries floating cleaning plugs from the convergent weir through a washing spray positioned to sluice away the accumulated scale, sediment, dirt and sludge gathered by the plugs from the cooling water tubes. A cooling water pump has its intake positioned far downstream in said flowing body of water or in a different body of water. Freshly washed plugs for recycled use join the cooling water stream ejected by the cooling water pump and the stream is then delivered to the heat exchanger cooling water tubes.

10 Claims, 4 Drawing Figures

WASHING METHODS AND APPARATUS FOR HEAT EXCHANGER TUBE CLEANING PLUGS

This invention relates to methods and apparatus for cleaning and recycling flexible floating cleaning plugs propelled by water pressure through the cooling water tubes of power plant heat exchangers. In particular, the invention utilizes a flowing body of water such as a canal or river adjacent to a power plant into which outlet cooling water is discharged. Buoyant cleaning plugs are added to the cooling water stream before it is introduced into the heat exchanger cooling water tubes of the power plant. These buoyant cleaning plugs are sized to match closely the internal diameter of the cooling water tubes, and are propelled along the tubes by the cooling water, scraping away slime, sediment, sludge, scale and dirt collected on the interior walls of the tubes and carrying these removed deposits out the other end of the cooling water tubes into the outflow stream of cooling water.

The outflow stream is discharged into the flowing body of water, and the cleaning plugs are carried by the current to be delivered to a washing spray station where accumulated deposits are washed off. Thereafter, the plugs are recovered and recycled by being introduced again into the intake stream of cooling water while the sediments and debris washed from the plugs are carried away downstream by the current flow.

BACKGROUND ART

A number of U.S. patents have described plunger or piston-shaped objects designed to be propelled along the interior of pipelines or similar conduits. These include such U.S. Pat. Nos. as 4,416,703, 4,413,370, 4,365,379, 4,275,475, and 4,173,806. In addition, a large number of United States patents describe methods and apparatus for separating heat transfer tube cleaning plugs or balls from the cooling water stream by such means as centrifugal separators, screens, sieves and the like, including such U.S. Pat. Nos. as 4,435,285, 4,385,660, 4,350,202, 3,882,931, and 4,351,387.

None of these prior art patents discloses, suggests or foreshadows the methods and apparatus of the present invention for conveniently separating the cleaning plugs from the outlet stream of cooling water, washing the plugs and recycling them by delivering them into the intake cooling water stream for reuse.

Accordingly, the principal object of the present invention to provide methods and apparatus for cleaning and recycling power plant heat exchanger cleaning plugs for repeated use.

Another object of the invention is to provide such methods and apparatus employing the normal current flow of an adjacent body of water for convenient and economical separation of the used cooling plugs and their delivery to a cleaning station.

Still another object of the present invention is to provide such methods and apparatus employing a washing spray station for cleaning of the cleaning plugs with the accumulated debris being carried away by the normal current flow of the adjacent body of water.

A further object of the invention is to provide such methods and apparatus employing a buoyant floating assembly for separation, washing and recovery of the floating cleaning plugs, incorporating a containment boom embracing a portion of the surface of the adjacent body of water with a downstream converging weir to guide the buoyant cleaning plugs into the entrance to a conveyor, carrying them to a washing zone still further downstream, where debris removed from the cleaning plugs in a washing operation is carried away downstream while the clean plugs are recovered and recycled.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

Figure 1:
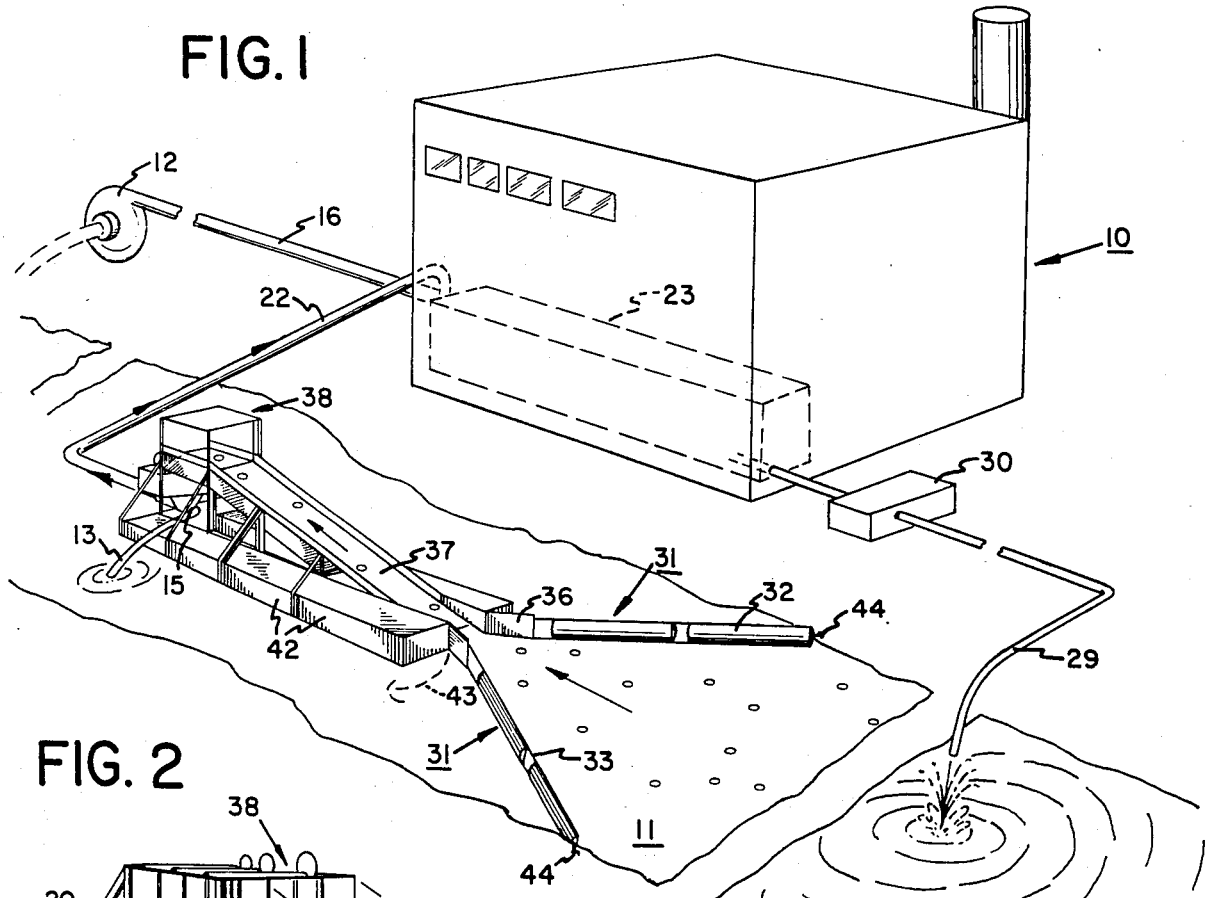
FIG. 1 is a schematic perspective view showing a power plant with its cooling water system cooperating with a plug cleaning assembly deployed beside the power plant.
Figure 3:
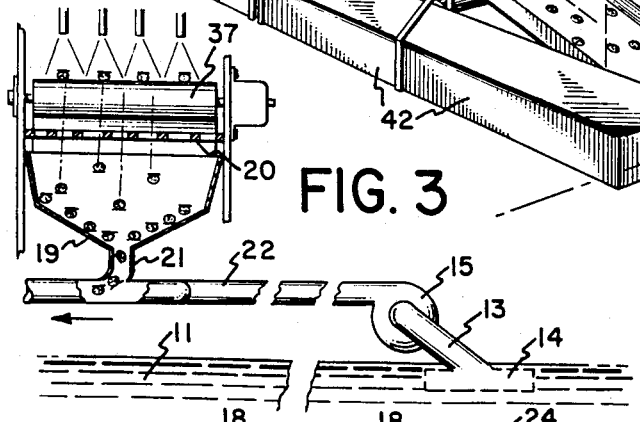
FIG. 3 is a cross-sectional elevation view of the washing zone and recovery hopper forming a part of the system illustrated in FIGS. 1 and 2.

The cleaning plug washing and recycling system and apparatus illustrated in FIG. 1 is shown deployed afloat on a flowing body of water adjacent to a power plant. The power plant 10 is constructed in a conventional way on the bank of a flowing body of water such as a canal 11. A cooling water intake pump 12 is positioned on the far remote downstream bank of canal 11 as shown in FIG. 1. Pump 12 delivers the major volume of cooling water through its delivery conduit 16 to a heat exchanger 23 in power plant 10. A second recycling pump 15 also draws water through an intake conduit 13 and a screened portal 14, and delivers this cooling water from canal 11 under pressure through recycling conduit 22 to the heat exchanger 23 in power plant 10. A continuous supply of freshly washed cleaning plugs 18 is delivered to recycling conduit 22 by way of a recovery hopper 19. The hopper's recycling outlet 21 directly joins recycling conduit 22 below hopper 19, as shown in FIG. 3.

Freshly washed cleaning plugs 18 from recycling conduit 22 thereby join the stream of pressurized cooling water traveling through delivery conduit 16, and the fresh supply of cooling water and freshly washed cleaning plugs is thus carried into the power plant 10 to heat exchanger 23. The cooling stream of water and entrained washed cleaning plugs 18 distribute themselves at random throughout the heat exchange tubes of heat exchanger 23. Heat exchange tube 24 forming one of the battery of such tubes employed in heat exchanger 23 is illustrated in FIG. 4 and a plurality of cleaning plugs 18 are shown traveling through tube 24 in various orientations.

Figure 4:
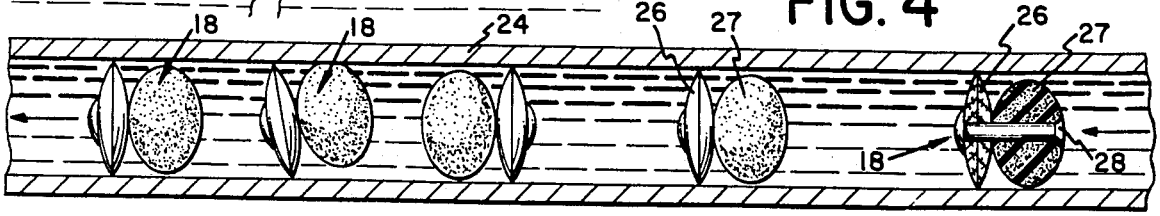
FIG. 4 is a cross-sectional elevation view showing a power plant cooling water heat exchange tube in which five of the cleaning plugs used in the present invention are shown being propelled along the tube from right to left in various cleaning orientations.

As shown in FIG. 4, each cleaning plug 18 comprises a cleaning disk 26 secured to an ellipsoidal buoyant float 27 by a rivet 28, and all three of these parts of plug 28 are preferably formed of lightweight polymer materials. As shown in FIG. 4, disk 26 is preferably formed from a relatively stiff, rigid lightweight polymer having a diameter only slightly less than the internal diameter of the tube 24. As the pressure of the cooling water stream carries each plug 18 through tube 24, the rim of each disk 26 closely engages the interior walls of tube 24, chattering and scraping as it proceeds to chip off and peel away accumulated deposits of scale, slime, sediment or other debris. Float 27 is preferably formed of polymer foam material provided with a tough external skin formed during the molding process and tending to minimize skuffing abrasion damage to the surface of float 27 during its passage down tube 24. Rivets 28 shown at the right-hand side of FIG. 4, anchoring each float 27 to its disk 26 are also preferably formed of lightweight polymer material such as nylon or polypropylene.

The orientation of plug 18 in tube 24 is immaterial As shown in FIG. 4, it may proceed disk first or float-first on its way down the tube. Slight misalignment or skewing of the plug 18, as shown at the left side of FIG. 4, merely changes the attack angle of the rim of disk 26 along the internal walls of tube 24. The shape of the ellipsoidal buoyant floats 27 prevent significant misalignment of each plug 18, maintaining each disk 26 deployed substantially transverse to the direction of the cooling water stream proceeding through tube 24. This exposes the surface of each disk 26 to the water pressure, and thus propels each plug 18 through tube 24 along with the stream of cooling water passing therethrough. Some of the debris removed from the interior walls of the tubes 24 is dissolved or entrained in the water stream itself, and other parts of the debris adhere to plugs 18 as the plugs travel through the tube 24.

The combined weight of the components of each plug 18 is selected to assure that plugs 18 are buoyant and will float when released from the cooling water stream issuing from heat exchanger 23. To maximize tumbling distribution of plugs 18 to all levels of the heat exchange tubes 24 in the intake manifold or plenum of heat exchanger 23, slight positive buoyancy of plugs 18 is preferred. By providing a large plurality of plugs 18, having a range of different positive buoyancy values, distribution of the plugs among cooling water tubes at different depths is facilitated.

The outlet stream from heat exchanger 23 is delivered to an outlet conduit 29, shown at the right-hand side of FIG. 1 from which it passes directly into canal 11 well upstream from a barrier 31, which is positioned to entrap the floating cleaning plugs 18 passing through outlet conduit 29 and delivered therefrom into canal 11. Plugs 18 are shown floating downstream toward barrier 31 in FIG. 1 and also in FIG. 2.

As indicated in the FIGURES, the barrier 31 is preferably formed as a floating boom such as those shown in my prior U.S. Pat. Nos. 3,146,598, 3,499,290, 3,638,430 and 3,756,031 for example, having a vertically arrayed thin flexible polymer fin suspended from a spaced plurality of buoyant floats and having its lower edge extending downward a suitable distance below the water surface, where it is held in position by stabilizing ballast weights secured to the fin at intervals. The barrier 31 shown downstream from the outlet of conduit 29 is formed as a pair of floating booms 32 each having a flexible polymer fin 33 arrayed vertically, carrying spaced buoyant floats 34 along its upper edge. The downstream ends of booms 32 converge at cleaning assembly 17, as shown in FIG. 1.

The cooling water outlet conduit 29 may discharge used cooling water several hundred yards upstream from cleaning assembly 17, providing ample time for plugs 18 plunged deep beneath the surface in the turbulent discharge to rise again to the surface as the current carries them downstream along canal 11. If desired, a separate upstream barrier may be deployed to deflect away from barrier 31 leaves, grass, twigs, branches, dead fish or other flotsam drifting downstream; this also blocks the escape of any cleaning plugs 18 which might be driven upstream along canal 11 by wind.

Under suitable conditions, the separate upstream barrier may be eliminated, particularly if the upstream entrance end of canal 11 is provided with an intake screen blocking the entrance of floating debris into the canal.

The downstream ends of both sides of boom 32 forming barrier 31 are anchored to a converging weir intake 36 at the right-hand end of the cleaning assembly 17 shown in the drawings. The converging sides of weir 36 serve to guide the floating buoyant plugs drifting downstream within the enclosure of barrier 31 into a position overlying the intake end of an elevating conveyor 37, an endless belt-type conveyor provided with perforations or slot interstices which allow water to drain from objects being carried forward and upward along conveyor 37.

The endless belt conveyor 37 extends from the weir 36 portion of barrier 31 diagonally upward in the downstream direction to and through an elevated washing zone 38 near the opposite elevated end of conveyor 37, where a plurality of high pressure water sprays are directed downward toward the perforated conveyor 37 and all of the cleaner plugs being carried along the conveyor.

Figure 2:
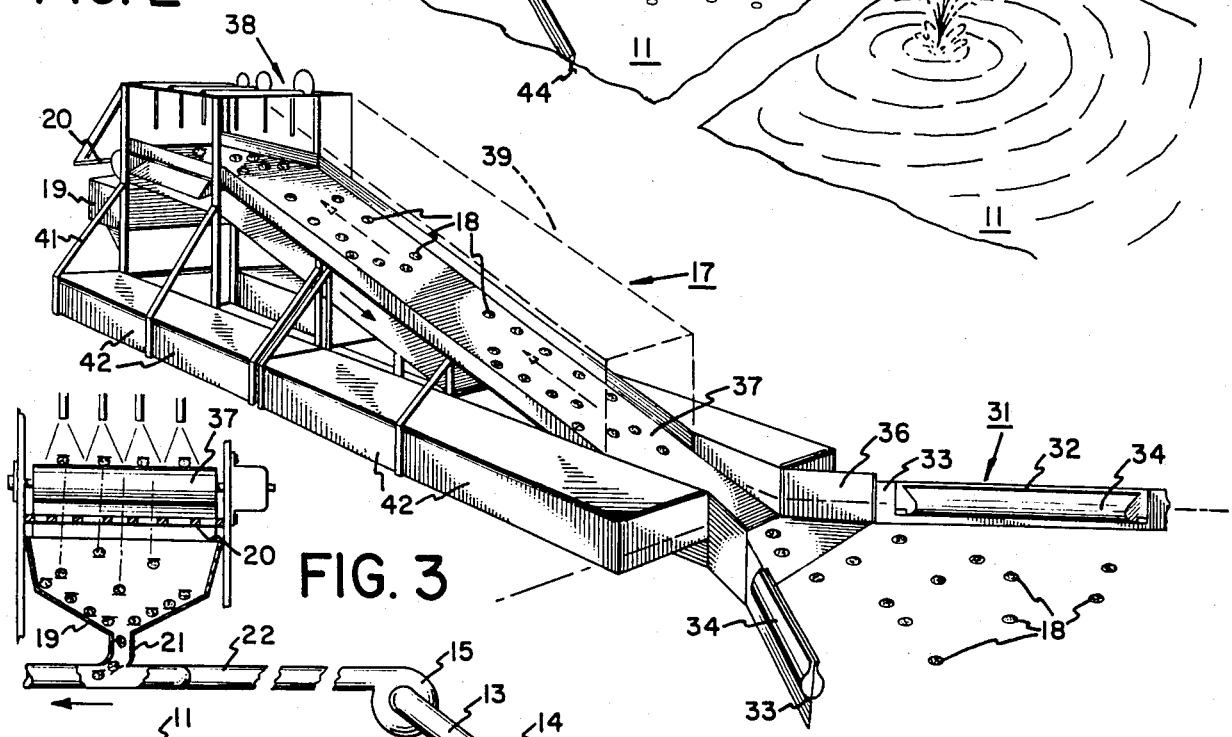
FIG. 2 is an enlarged perspective view of a buoyant floating weir, a conveyor and a washing assembly illustrating a portion of the overall system shown in FIG. 1.

If desired, an optional prewash zone 39 shown in dash lines in FIG. 2 may be employed, overlying a part or substantially the entire length of conveyor 37 from its converging weir entrance to the washing zone 38. For example, if washing sprays are positioned in prewash zone 39 directed toward the cleaner plugs 18 being carried therethrough along ascending conveyor 37, rinsing sprays may also be employed in the wash zone 38 to remove the remaining flotsam, sediment, slime, sludge, scale and other debris which is thus carried away downstream in canal 11.

A separator screen or grill 20 with openings passing plugs 18 but diverting larger flotsam downstream may be installed if desired after the wash zone 38, as shown in the FIGURES.

The cleaning plugs 18 are carried through and beyond wash zone 38 by conveyor 37, to the outlet end of the conveyor, where they fall vertically into a collecting hopper 19 shown in FIG. 3 and at the left end of FIG. 2. Hopper 19 is preferably provided with a slanting bottom formed in a converging funnel-shaped, pyramidal configuration, leading to hopper recyling outlet 21 which delivers the washed cleaning plugs directly to the cooling stream conduit 22 where they are introduced into the advancing fresh cooling water drawn through screen portal 14 by cooling water intake pump 12 and delivered along the delivery conduit 16.

As shown in FIGS. 1 and 2, the cleaning assembly 17 including conveyor 37, wash zone 38 and prewash zone 39 is supported by suitable structural framework 41 mounted on large buoyant floats 42. The upstream end of floats 42 is preferably anchored in canal 11 with suitable ground tackle, including mooring lines, chains and anchors 43 of sufficient weight to embed themselves in the canal bottom, in order to withstand the effects of current or wind and thus position the assembly 17 in the desired moored position on the canal. In the same manner, barrier 31 comprising the converging floating booms 32 is also anchored by its ends to the canal bank and the canal bottom by suitable ground tackle such as anchors 44, which are provided with sufficient length or scope of anchor rode to assure firm solid anchoring of the floating booms 32 and avoid dragging or displacement of the barrier by flood currents or high winds. Employing buoyant floating structures as the cleaning assembly 17 and the containment barrier 31 assures automatic deployment of the barrier and the conveyor intake at weir 36 at the water's surface, automatically compensating for variations in water level caused by tides, storms or floods.

The recirculation of cleaning plugs 18 may be interrupted and the plugs diverted from conduit 29 by a screen, a sieve or other diversion means 30 during heavy weather, to avoid loss of plugs from barrier 31 or conveyor 37 by wind or wave action.

The recycling conduit 22 receiving the cleaning plugs from hopper 19, by which the combined stream of cooling water and washed cleaning plugs is delivered into the power plant 10, is preferably formed of flexible hose or tubing. This permits flexing and movement of the floating cleaning assembly 17, relative to the power plant 10 on the canal bank, as the position of the floating assembly is influenced by winds, flood currents, fluctuating water levels and the like.

The returning lower section of the endless belt forming conveyor 37 can be seen in FIG. 2, passing underneath the wash zone 38 and also underneath the prewash zone 39, where the belt's perforations or interstices allow water and debris carried from the cleaning plugs on the upper surface of conveyor 37 to pass directly through both levels of the conveyor and to drop into canal 11 where they are carried away downstream.

Such accumulated debris is not a source of pollution for canal 11, since it comprises only flotsam, sediments or dissolved salts carried naturally into intake portal 14 and circulated through the system which have been deposited and come to rest inside heat exchange tubes 24. For this reason, removal of these deposits from tubes 24 and the washing of such removed debris from cleaning plugs 18 into the canal 11 merely returns to the canal materials which occur naturally and would tend to accumulate and clog the heat exchange tubes if not removed in the manner here described.

The shape and slope of conveyor 37 and the particular configuration of the wash and prewash zones 38 and 39 may be varied as desired, and the preferred embodiment described and illustrated in the drawings is believed to be an economical and highly effective embodiment of the invention.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Apparatus for cleaning and recycling flexible floating cleaning plugs introduced into the tubes of a power plant heat exchanger located near a flowing body of water comprising A. a recycling pump having its intake positioned in a body of water and its outlet connected to one end of the heat exchanger tubes to deliver cooling water, B. a cooling water outlet conduit connected to deliver used cooling water from the other end of the heat exchanger tubes and a plurality of said flexible floating cleaning plugs propelled therethrough to discharge them into said flowing body of water, C. a containment barrier positioned downstream from the discharge of the outlet conduit, and having a convergent weir region at its downstream end, D. an upward traveling conveyor positioned to pick up floating cleaning plugs arriving at the convergent weir which separates the plugs from the flotsam and conveys them through a washing zone, E. washing spray means in the washing zone positioned to sluice away from said plugs carried by said conveyor the accumulated flotsam, scale, sediment, dirt and sludge gathered by the plugs from the heat exchanger tubes, and F. a recycling conduit positioned to receive washed plugs emerging from the washing zone and deliver them for recycled use into the heat exchanger tubes.

2. The apparatus defined in claim 1 wherein the containment barrier is formed as a converging pair of floating booms deployed on the flowing body of water and anchored in position juxtaposed to the power plant heat exchanger.

3. The apparatus defined in claim 2 wherein the containment barrier converging floating booms have their diverging ends anchored upstream from said convergent weir.

4. The apparatus defined in claim 3, wherein said diverging boom ends are secured to respective banks of said flowing body of water.

5. The apparatus defined in claim 1 wherein the conveyor and the washing spray means are mounted on buoyant float support means, anchored in position juxtaposed to the power plant heat exchanger.

6. The apparatus defined in claim 1 wherein the conveyor is formed as an endless belt having openings therethrough, allowing wash water and rinse water delivered to objects carried by the conveyor to drain through the openings.

7. The apparatus defined in claim 1 wherein the washing zone extends over substantially the entire length of the conveyor.

8. The apparatus defined in claim 1 further including a prewashing zone overlying the conveyor between the convergent weir and the washing zone.

9. The apparatus defined in claim 1 further including a hopper positioned to receive washed cleaning plugs exiting from the conveyor and having an outlet connected to said recycling conduit.

10. The apparatus defined in claim 1 further including diversion means interposed in the cooling water outlet conduit connected to divert cleaning plugs from the used cooling water traveling through the outlet conduit upon command, whereby cleaning plugs are not discharged into the flowing body of water.

* * * * *